US005450874A

United States Patent [19]

Hamula

[11] Patent Number: 5,450,874

[45] Date of Patent: Sep. 19, 1995

[54] DENTAL INSTRUMENT HOSE RETRACTION DEVICE

[76] Inventor: Warren Hamula, 1539 S. Eighth St., Colorado Springs, Colo. 80906

[21] Appl. No.: 270,758

[22] Filed: Jul. 5, 1994

[51] Int. Cl.[6] ..... B65H 74/34

[52] U.S. Cl. ..... 137/355.25; 137/355.23; 312/209; 242/47.5

[58] Field of Search ..... 137/355.23, 355.25, 137/355.17; 312/209; 242/47.5

[56] References Cited

U.S. PATENT DOCUMENTS

| | | | |
|---|---|---|---|
| 1,458,115 | 6/1923 | Caldwell . | |
| 2,131,297 | 9/1938 | Pieper | 32/22 |
| 3,427,719 | 2/1969 | Gordon et al. | 433/78 |
| 3,429,516 | 2/1969 | Sharp et al. | 242/47.5 |
| 3,514,171 | 5/1970 | McGaha | 433/78 |
| 3,793,729 | 2/1974 | Nyboer | 32/23 |
| 3,874,488 | 4/1975 | Wirth | 191/12 R |

FOREIGN PATENT DOCUMENTS

| | | | |
|---|---|---|---|
| 1774629 | 9/1978 | Germany | 242/47.5 |
| 2713616 | 10/1978 | Germany | 433/78 |

*Primary Examiner*—A. Michael Chambers
*Attorney, Agent, or Firm*—Fields, Lewis, Rost & Smith

[57] ABSTRACT

A device for retracting and storing a length of hose is provided. The device is housed within a dental cabinet and includes a rectangular compartment formed by integral side walls and front and rear walls. A plurality of spool supports are positioned adjacent to the side walls. A spool is positionable within the compartment. A length of hose anchored at the rear wall is routed under the spool and through an opening in an instrument panel of the dental cabinet. At the distal end of the hose is attached the desired dental tool. In retracted position, the hose hangs in a loop or bight with the spool supported on the bight. The weight of the spool normally keeps the hose under tension. The device is operated by pulling on the distal end of the hose such that the spool is lifted onto and secured by the spool supports. In this position, tension is released from the hose. The hose is retractable by exerting a quick jerk or pull on the distal end of the hose which dislodges the spool from the spool support causing the spool to displace vertically down into the compartment, exerting a downward force on the hose to retract it.

17 Claims, 3 Drawing Sheets

DENTAL INSTRUMENT HOSE RETRACTION DEVICE

TECHNICAL FIELD

This invention relates generally to a device for retracting and storing a length of hose or the like. More specifically, this invention relates to a device for retracting and storing dental instrument hose when used in the performance of dental services.

BACKGROUND ART

Devices for retracting and storing hose and other tubular members have been commercially available for many years. Such devices are commonly found at service stations for providing air, water or other fluids to a vehicle. Other applications include those for industrial use in which a length of hose is necessary to provide air or other fluids to a manufacturing process.

In the medical and dental field, it also has been common to encounter devices for retracting and storing lengths of hose which are used in surgical or dental processes. Common to these applications have been devices in which the length of hose is retained within some container with means provided to retract the hose when not in use. Also, a means has been provided to release tension on the hose when the hose is in use by use of some holding mechanism or the like.

U.S. Pat. No. 3,429,516 to Sharp et al., discloses a support device housed within a cabinet for dental equipment of the type that has a flexible hose connected at one end with a dental drill or other hand instrument and is connected at the opposite end to a source of fluid or vacuum. This device includes a weighted pulley which provides tension on the hose such that the hose may be retracted within the support when not in use. A catch mechanism integral with the pulley assembly latches the pulley assembly temporarily to relieve tension on the hose when the hose is extended and in use. The catch mechanism includes a hook means which may be unhooked by pulling angularly of the instrument end of the hose, whereby the weight of the pulley assembly may then draw the hose back into the cabinet.

U.S. Pat. No. 3,793,729 to Nyboer, discloses a device for maintaining tension on a length of hose, releasing tension when the hose is extended to a desired length and retracting the hose into a housing when the hose is not in use. Tension on the hose is released by means of a ball member and sloping surface in which movement of the hose causes the ball member to travel upwards along the sloping surface. As the ball travels, it enters a compartment in which the ball frictionally engages and holds the hose against a top wall. Tension may be returned to the hose by pulling on the distal end of the hose in an angled direction whereby the ball member rolls down the sloping surface and away from the compartment.

U.S. Pat. No. 3,874,488 to Wirth, discloses an electric cord retrieving device for appliances, comprising a box mounted within a wall wherein the box has a multiple plug receiving bar member from which the cords extend. The cords each have a pulley and attached weight which provides tension on each of the cords and retracts the respective cords when not in use. When in use, tension is released from the cords by means of finger holders which frictionally engage each hose.

U.S. Pat. No. 1,458,115 to Caldwell, discloses a device for housing and retracting flexible hose in which tension is maintained on the hose by a pulley and weight mechanism. When the hose is in use and extended away from the device, tension is released by means of a locking door mechanism which closes on the hose and thus frictionally engages the hose preventing it from retraction. To permit the return of the hose to the housing, it is necessary to lift a locking weight which releases the doors and then swing the doors outwardly away from engagement with the hose.

U.S. Pat. No. 2,131,297 to Pieper, discloses a cord strain relief means in which a length of flexible hose is retained within a housing having a pulley and weight which maintain tension on the hose. When in use, tension is released by a spring loaded clip which frictionally engages the hose. Release of the hose into the housing is achieved by pulling the cord upward and laterally away from the spring clip.

The aforementioned patents demonstrate that there are many ways in which a length of hose may be retracted and stored within a housing while providing a means to release tension when the hose is in use. Each of these patents may function according to their intended purpose, however, none disclose the novel device as set forth herein. In particular, none are as simple in operation or construction wherein a limited number of moving parts are provided to limit wear and malfunctioning of such parts.

DISCLOSURE OF THE INVENTION

In accordance with this invention, a device for releasably retracting and storing dental instrument hose is provided. The device is housed within a dental cabinet and includes a pair of parallel and vertically arranged side walls which are attached perpendicularly to a front and rear wall. A generally rectangular compartment is formed between the side walls and front and rear walls.

Attached to each side wall in facing relationship is a pair of spool supports. In a first embodiment, the spool supports extend parallel with the side walls. The spool supports each have a curved front edge including an upper downwardly and forwardly sloping portion, a concave portion forming a rest, a protruding offset portion, and a lower vertical portion. The concave portion is contiguous with the offset portion such that a resulting "S" shape is formed from the upper downward sloping portion through the concave portion and offset portion to the lower vertical portion.

In a second embodiment, the spool supports have a curved front edge including an upper downwardly and forwardly sloping portion, a stop portion, and a lower vertical portion.

A weighted spool is placed within the compartment created by the walls. The spool is sized such that it is capable of vertical and rotational translation within the compartment. The spool has a center cylindrical portion defining a center axis that lies perpendicular to the side walls. A length of dental hose having a distal and proximal end is attached at the proximal end to an anchor means that is located behind the rear wall. Beginning at the anchor means, the distal end of the dental hose is routed through an opening in the rear wall and under the weighted spool. The hose is then routed through an opening in the instrument panel that covers the top portion of the compartment. The distal end of the hose is then attached to the desired dental instrument.

In the retracted position, the hose hangs inside the compartment so as to form a loop or bight. The spool rests on the loop or bight and maintains tension on the dental hose by its weight on the hose. The tension on the hose may be varied by increasing or decreasing the weight of the spool. For example, the interior of the cylindrical portion of the spool may be filled at different levels with a weighted substance to accommodate the needed tension. When it is desired to extend the hose, the distal end of the hose is pulled away from the instrument panel. When the hose is extended to a desired predetermined position, the weighted spool is lifted by the hose onto the spool supports thereby releasing the tension created by the spool on the hose. When it is desired to retract the dental hose back inside the compartment, a jerk or quick pull dislodges the spool from the spool supports such that the weighted spool may displace vertically downward into the compartment.

In the first embodiment, the concave portion of the support allows the spool to be held, thereby preventing dislodgement if the distal end of the hose is inadvertently pulled without a deliberate dislodging jerk. The angular relationship between the concave portion and the offset portion of the spool support may be varied to enable a change in the amount of pull necessary to dislodge the spool from the supports. That is, a deeper cut concave portion would necessitate a greater pull to dislodge the spool.

In the second embodiment, the stop portion of the front edge causes the spool to be retained on the support. The magnitude of vertical extension of the stop portion above the downward sloping portion determines the amount of pull necessary to dislodge the spool. That is, a higher extending stop portion creates a greater barrier in which the spool must overcome in order to become dislodged.

A plurality of hoses may be retained within a single dental cabinet by arranging a series of compartments in a side-by-side relationship. Additionally, more than one hose may be placed within each compartment in order to facilitate a greater number of hoses available for use within a single cabinet.

The advantages of this device are apparent. A device has been provided which allows the retraction of dental hose which does not require a complex configuration of pulleys and weights. Since the needed length of hose is usually constant, particularly in a dental application in which the position of the patient's chair is fixed, this device has a further advantage because the release of hose tension occurs at a predetermined length. Furthermore, since there are few moving parts, the device is extremely easy to assemble and maintain. Finally, since the device is of a simple construction, it is less costly to manufacture.

Accordingly, a device has been provided which is economical and simple in construction, yet has the ability to retract and store the necessary quantity of hose in a dental or other suitable application. Additional advantages of this invention will become apparent from the description which follows, taken in conjunction with the accompanying drawings.

BEST MODE FOR CARRYING OUT THE INVENTION

Figure 1:
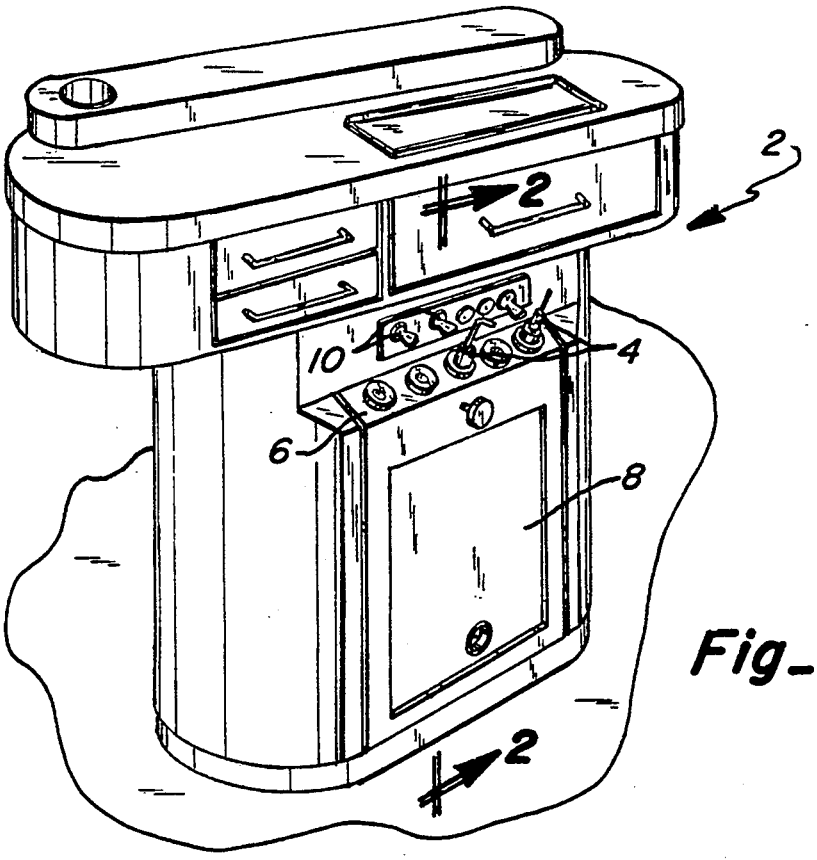
FIG. 1 is a perspective view of a dental cabinet, in a closed position, which houses the hose retraction device of this invention.

In accordance with this invention, a dental cabinet 2 is provided that includes a plurality of dentist's tools 4, an instrument panel 6, and suitable control switches 10. The cabinet 2 houses the hose retraction device, which is the invention described herein. The dental cabinet 2 further includes a front access door 8 which allows access to the hose retraction device for maintenance or other adjustment purposes.

Figure 2:
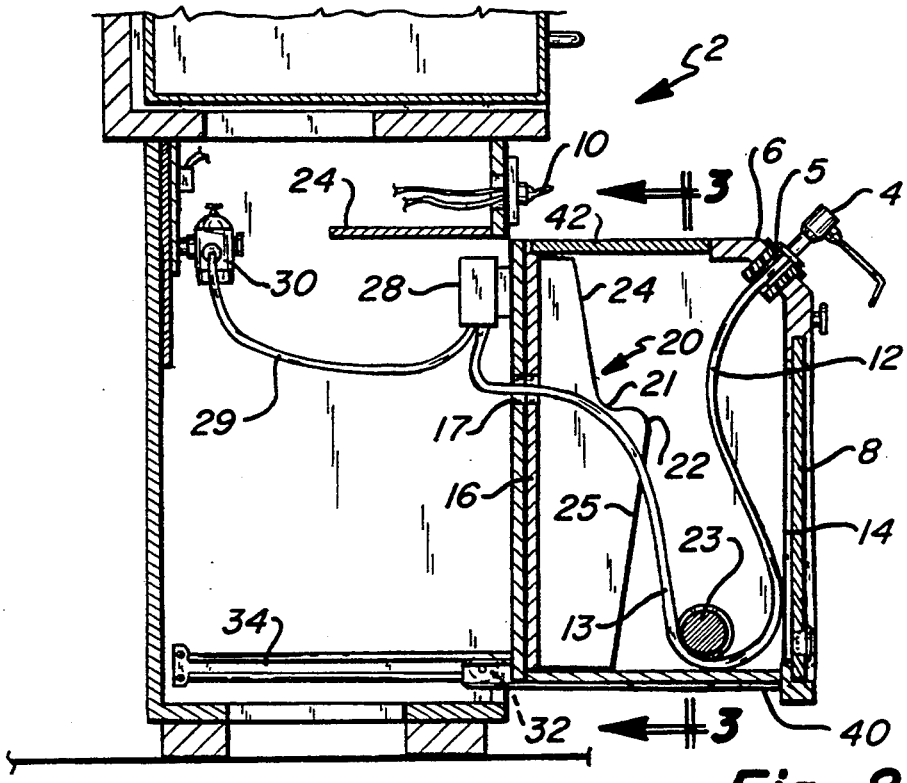
FIG. 2 is an enlarged vertical section, taken along line 2—2 of FIG. 1, but with the cabinet in an open position, showing the interior details of the hose retraction device in the retracted position.
Figure 3:
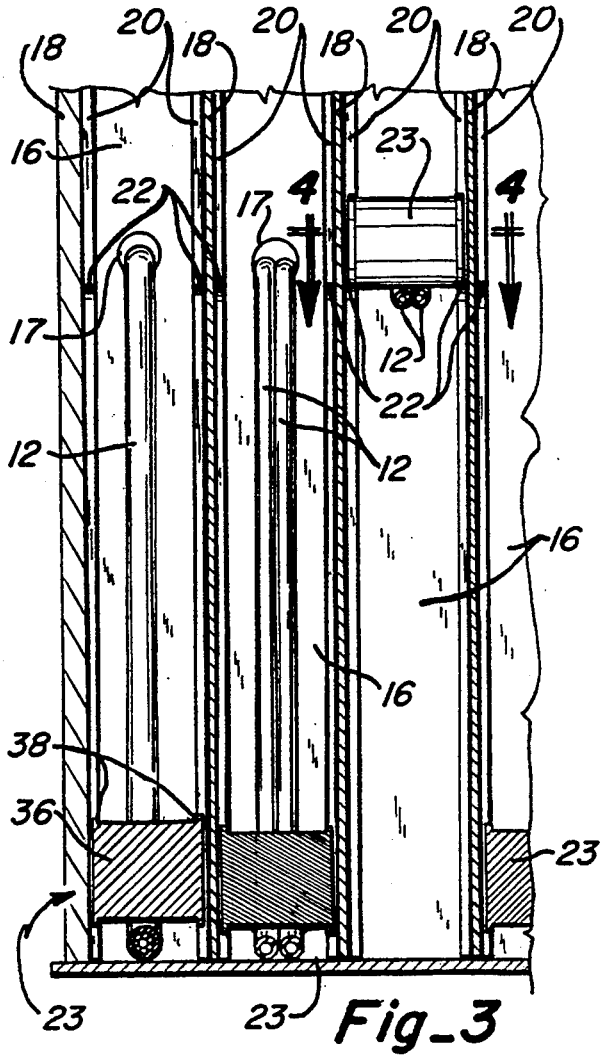
FIG. 3 is an enlarged vertical section, taken along line 3—3 of FIG. 2, showing additional details of the invention wherein two compartments are in the retracted position and a third compartment is in the extended position.

As shown in FIGS. 2 and 3, the invention includes a plurality of laterally spaced dental hoses 12 which are retained within a generally rectangular shaped compartment defined by a front wall 14, a rear wall 16, and side walls 18 perpendicular to and attached to front and rear walls 14 and 16. Within each compartment is a pair of spool supports 20 which are attached to the side walls 18 and rear walls 14 such that the supports extend parallel with the side walls 18. Within each compartment is placed a spool 23. The dental hose 12 is attached at its proximal end to a fitting or anchor 28 mounted on the rear wall 14. Air or fluid is supplied to anchor 28 by hose 29 connected between anchor 28 and regulator 30. The regulator controls the fluid pressure. Starting at the proximal end, the dental hose 12 is inserted through an opening 17 in the rear wall and then routed underneath the spool 23. The distal end of the dental hose 12 is then inserted through an opening 5 in the instrument panel 6. The distal end of the hose 12 is attached to the desired dental tool 4.

As shown in FIG. 2, the walls 14, 16 and 18 forming the compartments may be attached to rollers 32 which are journalled within guides 34 such that the compartments may be pulled away from the dental cabinet 2. This feature allows one to access a compartment for purposes such as repair of dental instrument hose 12 or replacement of the spool 23 with one of a more desirable size or weight.

As shown in FIG. 3, a series of walls 18 and spool supports 20 may be placed side-by-side to facilitate housing a number of dental hoses 12. As shown in FIG. 3, it may be possible to use a number of hoses 12 within the same compartment to further conserve cabinet space.

Figure 5:
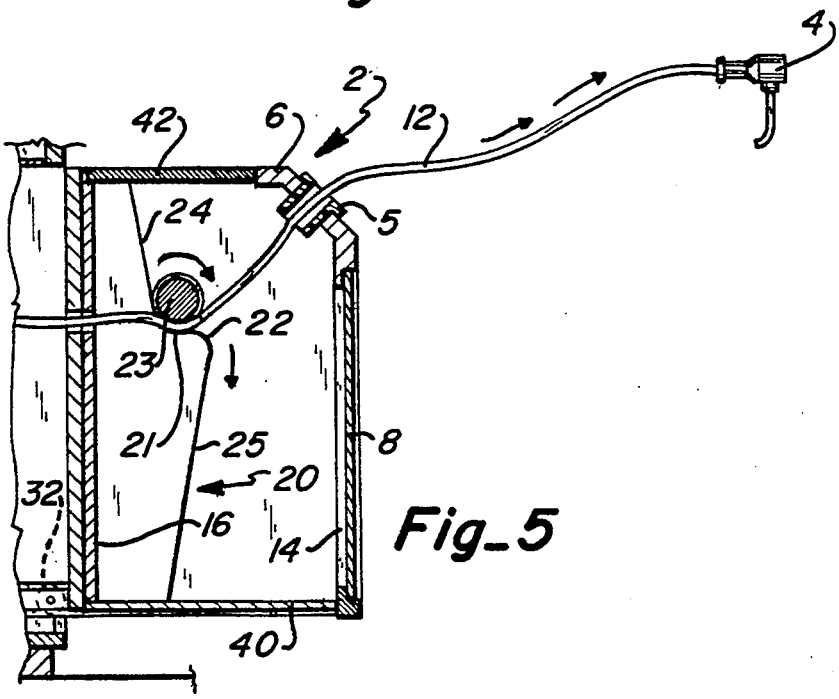
FIG. 5 is a fragmentary vertical section, similar to a portion of FIG. 2, but showing the hose retraction device in the extended position.

In operation, the hose 12 has two positions, namely, the retracted position as shown in FIG. 2, wherein spool 23 rests by its own weight on the loop or bight 13 to hold hose 12 under tension, and the extended position as shown in FIG. 5. When it is desired to utilize a tool 4, the distal end of the hose 12 is pulled away from the dental cabinet 2 by the tool 4 under the tension created by the downward force of the spool 23. This causes the spool 23 to be lifted onto the spool support 20. In this position, tension is released on the hose 12 and a dentist is free to use the tool 4.

Figure 6:
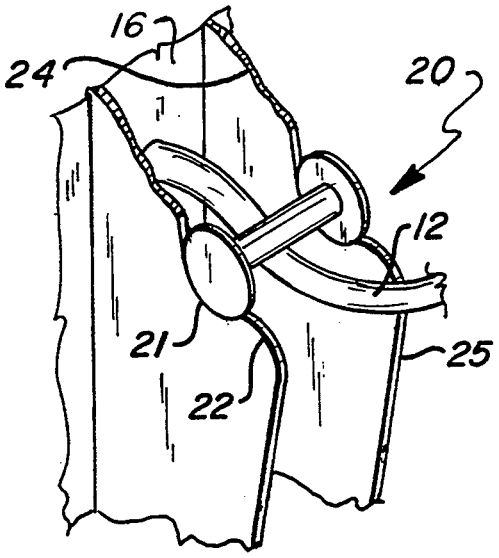
FIG. 6 is a further enlarged fragmentary vertical section, showing the details of the support element according to a first embodiment.

In a first embodiment, as shown in FIGS. 2, 5 and 6, the front edge of each spool support 20 has an upper downwardly and forwardly sloping portion 24, connected to generally concave portion 21 and forming a rest. On the forward end of concave portion 21 is connected an offset portion 22 which terminates in a lower vertical extending portion 25. The spool 23 is held by resting upon the concave portion 21. Portions 21, 24, and 25 are contiguous such that a curvilinear shape resembling a vertically positioned letter "S" is formed.

Figure 7:
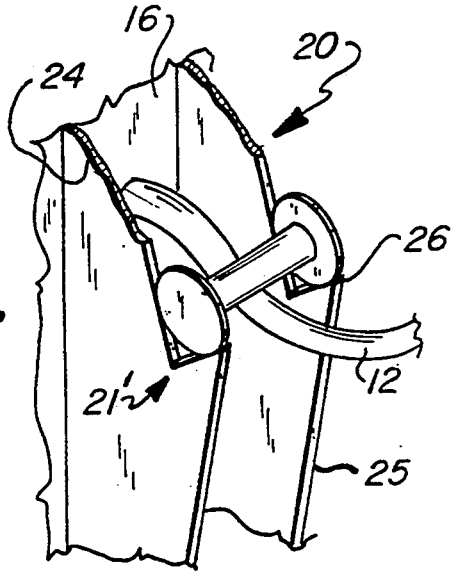
FIG. 7 is another enlarged fragmentary vertical section, similar to FIG. 6, but showing the details of the support element according to a second embodiment.

In a second embodiment, as shown in FIG. 7 the spool supports 20 comprise a front edge having a downward sloping portion 24, a stop portion 21' and a lower vertical extending portion 25. As in the concave portion of the first embodiment, the stop portion 21' serves to retain the spool when the hose 12 is extended such that the spool 23 is lifted above and behind the stop portion 21'. The shape of the stop portion 21' is typically triangular in which a pointed corner 26 is the highest vertical extension in relation to sloping portion 24.

In either embodiment, when it is desired to retract the hose 12, a deliberate jerk or pull on the distal end of the hose 12 releases the spool 23 by creating both an upward vertical force component and a forward force component on the spool and allows it to move upwardly and forwardly so that it clears the offset portion 22 of the first embodiment or the stop portion 21' before it begins to fall under its own weight, upon release of the tool, into the compartment. The offset portion 22 of the first embodiment or stop portion 21' of the second embodiment prevents the spool 23 from inadvertently falling down into the compartment if the distal end is mistakenly pulled without the deliberate jerking motion. Once released, the spool 23 provides adequate tension on the dental hose 12 for retraction.

Figure 8:
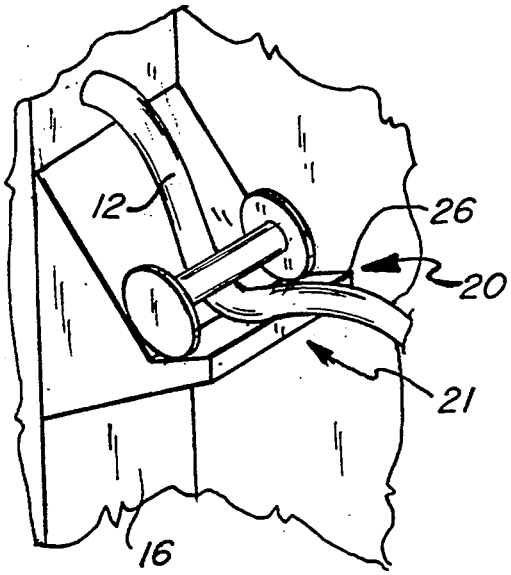
FIG. 8 is another enlarged fragmentary vertical section showing the details of a modified first embodiment wherein the support element is attached directly to the rear wall of the device.
Figure 9:
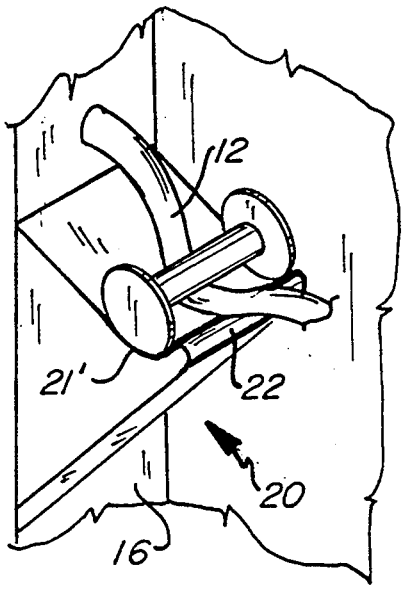
FIG. 9 is still another enlarged fragmentary vertical section showing the details of a modified second embodiment wherein the support element is attached directly to the rear wall of the device.

As shown in FIGS. 8 and 9, the support element 20 may be directly attached to the rear wall 16 wherein the upper downward sloping portion 24 and lower vertical portion 25 are eliminated. That is, the rear wall 16 can serve the same substantial structural function of the portions 24 and 25. Thus, FIG. 9 represents the first embodiment in accordance with the above described modifications and FIG. 8 represents the second embodiment in the same manner.

The tension on the dental hose 12 may be varied according to the weight of the spool 23. It is possible to increase the size of the spool 23 or to fill the interior portion of the spool 23 with substances of varying weight.

Figure 4:
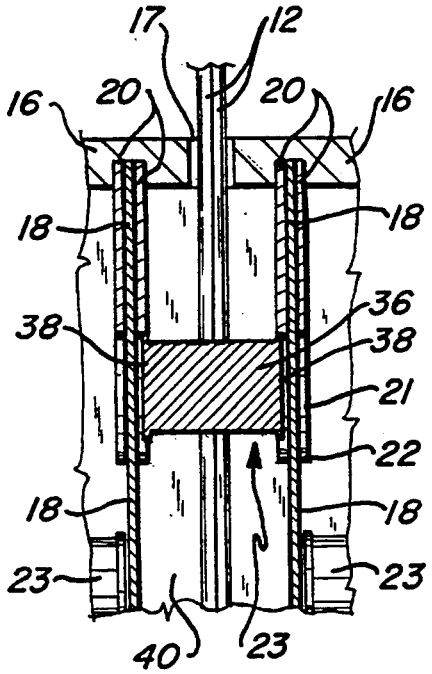
FIG. 4 is a horizontal section, taken along line 4—4 of FIG. 3, showing the hose retraction device in the extended position.

As shown in FIGS. 3 and 4, the spool is configured such that it includes a generally cylindrical portion 36 and two outer plates 38 positioned at opposite ends. Vertical translation of the spool 23 inside the compartment is enhanced by the ability of the spool 23 to roll up and down along the dental hose 12. The spool 23 is typically sized such that it is in close proximity to the side walls 18 running parallel thereto. As shown in FIG. 4, the spacing of the side walls 18 and spool supports 20 is such that the outer plates 38 of the spool 23 rest upon the spool supports 20. It will be understood that depending upon the shape of the spool 23 and the spacing of the supports 20, it is possible to retain the spool 23 on the cylindrical portion 36 and thus the invention is not restricted to the outer plates 38 resting on spool supports 20.

Vertical translation of the spool is limited by lower stop 40 and upper stop 42. The lower stop 40 is a single bottom wall or panel which bounds the bottom edges of the side walls 18, rear wall and front wall 14 and 16. In the same respect, the upper stop 42 is a single panel which defines the upper limit of vertical translation of the spool 23.

From the foregoing, a device has been provided which is capable of storing and retracting a desired quantity of hose lengths. The cabinet housing the device may have a plurality of compartments such that a desired number of hoses can be stored and retracted. The shape of the spool support is easily alterable such that the amount of pull needed to dislodge the spool can be varied. Due to its simple construction, the device is a reliable and economical means for retaining and retracting hoses.

It will be understood that this device is not limited to specific spool structures recited herein. It is possible to utilize any weighted device which is placed over a length of hose such that the weight can be lifted onto a support for releasing tension on the hose. Furthermore, as shown in FIGS. 8 and 9, the spool support itself could comprise a structure which may be directly attached to a rear or side wall of the current invention.

In yet another embodiment (not shown), a single spool support could be spaced between two side walls wherein the support has a sufficient thickness enabling it to hold a desired shaped spool.

This invention has been described in detail with reference to particular embodiments thereof, but it will be understood that various other modifications can be effected within the spirit and scope of this invention.

What is claimed is:

1. A device for releasably retracting and storing a length of hose, said device positionable within a cabinet structure, said device comprising:

means for placing tension on a length of hose for retracting said hose within said cabinet, said hose having a distal and proximal ends, said distal end routed under said tension placing means;

means for retaining said tension placing means in a confined horizontal and vertical compartment;

means for supporting said tension placing means wherein said tension placing means is positionable on top of said supporting means when said hose is pulled away at said distal end, said hose being retractable within said compartment when said tension placing means is within said compartment and tension being released from said hose when said tension placing means is placed upon said supporting means; and means for rigidly attaching said proximal end of said hose to an anchor means such that said distal end of said hose is extendable away from said cabinet.

2. A dental cabinet comprising:

a plurality of said devices of claim 1 arranged in side-by-side configuration.

3. Device, as claimed in claim 2, wherein:

each support corresponds to and is attached to a respective side wall.

4. A hose retraction device for use in a cabinet structure, said device comprising:

a pair of side walls spaced apart and interconnected by a rear and a front wall to form a compartment, said compartment having an upper and a lower end, said front wall having a hose receiving opening adjacent said upper end of said compartment;

a hose having a proximal end mounted in a fixed position adjacent said upper end of said compartment and a distal end received in said hose receiving opening, said hose being movable between an extended position wherein said hose is pulled away at said distal end and a retracted position wherein said hose is stored within said compartment;

a weighted spool positioned within said compartment for free vertical movement therein, said spool being positioned above and resting on said hose resulting in a tension force applied to said hose and causing said hose to be held in said retracted position;

at least one spool support adjacent said upper end of said compartment for releasably supporting said weighted spool and thereby releasing tension on said hose, said spool being positionable on said spool support when said hose is in said extended position.

5. A device as claimed in claim 4, wherein each of said at least one spool support comprises:

an upper portion having a downward sloping front edge;

a concave portion forming a rest adjacent to a lower end of said upper portion;

an offset portion communicating with and forwardly of said concave portion, said weighted spool being retainable on said concave portion when said hose is in said extended position, said weighted spool being releasable from said concave portion by jerking said distal end of said hose away from said cabinet structure; and a lower vertical extending portion attached to said offset portion.

6. A device, as claimed in claim 4, wherein said weighted spool includes:

a cylindrical tube having a first and second ends;

a first end plate attached to said first end of said cylindrical tube; and a second end plate attached to said second end of said cylindrical tube.

7. A device, as claimed in claim 6, wherein:

said plates are positionable in near contact with and parallel to said side walls and said spool supports such that said weighted spool is capable of free vertical and rotational translation within said compartment.

8. A device, as claimed in claim 4, wherein each of said at least one spool support comprises:

an upper downward sloping front edge;

a stop means positionable at a lower end of said downward sloping front edge; and a lower vertical extending portion attached to said stop means, said weighted spool retainable on said at least one spool support when said hose is in said extended position, said weighted spool releasable from said at least one spool support when said hose is jerked at its distal end away from said cabinet structure.

9. A dental cabinet comprising:

a plurality of said hose retraction devices of claim 6 arranged in side-by-side configuration.

10. A dental cabinet comprising:

a plurality of said devices of claim 4 arranged in side-by-side configuration.

11. Device, as claimed in claim 10, wherein each of said supports comprise:

a panel having an upper end and a lower end, said panel having a front edge which has an offset portion adjacent said upper end thereof and forming a rest to support one of said spool ends when said hose is in said extended position.

12. A hose retraction device for use in a dental cabinet, said device comprising:

a pair of parallel vertical side walls spaced apart a first distance and interconnected by a rear wall and a front wall to form a compartment, said compartment and each of said walls having an upper end and a lower end, said front wall having a hose receiving opening adjacent said upper end thereof;

a hose having a proximal end mounted in a fixed position adjacent said upper end of said rear wall at substantially the midpoint between said side walls and a distal end slidably received in said hose receiving opening for movement of said hose from between a retracted position wherein said hose forms a loop which extends from said fixed position down to said lower end of said compartment and up through said hose receiving opening and an extended position wherein said hose extends in a substantially straight path from said rear wall to said hose receiving opening in said front wall;

a spool positioned between said side walls for free rotational and vertical movement within said compartment and having a length slightly shorter than said first distance, said spool having a center axis generally perpendicular to said side walls, a center portion having a first diameter and opposite ends which have a second diameter which is greater than said first diameter, said spool being positioned above and resting on said hose resulting in a tension force applied to said hose and having sufficient weight to normally hold said hose in said retracted position;

a pair of supports adjacent said upper end of said compartment for releasably supporting the weight of said spool when said hose is in said extended position to release tension from said hose, said supports being spaced apart a sufficient distance to support said spool by said spool ends and being configured to release said spool when said distal end of said hose is jerked when said hose is in said extended position so that said center portion of said spool rests on said hose and the weight of said spool pulls said hose from said extended position to said retracted position.

13. A dental cabinet comprising:

a plurality of said hose retraction devices of claim 10 arranged in side-by-side configuration.

14. A hose retraction device comprising:

parallel walls having upper and lower ends and rear and forward edges, respectively;

a hose having a first end fixedly mounted between said parallel walls adjacent said upper ends and said rear edges thereof and a distal end movably mounted between said parallel walls adjacent said upper ends and said forward edges thereof, said hose having an extended position in which said distal end is moved away from said forward edges of said parallel walls and said hose having a retracted position forming a curved bight adjacent said lower ends of said walls with said distal end positioned adjacent said forward edges of said parallel walls;

a spool resting on said bight and positioned between said parallel walls for free vertical movement therebetween, said spool being positioned above and resting on said hose for exerting a downward force on said hose to hold said hose under tension; and spool support means positioned adjacent said upper ends of said parallel walls for supporting said spool, said spool being positionable on said spool support means to relieve the tension on said hose when said hose is in said extended position.

15. A device, as claimed in claim 14, wherein each of said spool support means comprise:

a panel having an upper end and a lower end, said panel having a front edge which has an offset portion adjacent said upper end thereof and forming a rest to support one of said spool ends when said hose is in said extended position.

16. A dental cabinet comprising:

a plurality of said hose retraction devices of claim 14 arranged in side-by-side configuration.

17. A dental cabinet comprising:

a plurality of said hose retraction devices of claim 15 arranged in side-by-side configuration.

* * * * *